United States Patent [19]

Stirling

[11] 4,346,510

[45] Aug. 31, 1982

[54] PRETENSIONING DIAGONALS IN LATTICE BEAM-COLUMNS

[75] Inventor: Leonard H. Stirling, Verona, Canada

[73] Assignee: Her Majesty the Queen, Ottawa, Canada

[21] Appl. No.: 126,998

[22] Filed: Mar. 3, 1980

[30] Foreign Application Priority Data

Mar. 29, 1979 [CA] Canada ..... 324563

[51] Int. Cl.[3] ..... B21D 39/00; E04C 3/10

[52] U.S. Cl. ..... 29/452; 29/155 C; 52/223 R; 52/226; 52/655

[58] Field of Search ..... 29/452, 446, 155 C; 52/655, 657, 226, 225, 223 R

[56] References Cited

U.S. PATENT DOCUMENTS

| | | | |
|---|---|---|---|
| 357,290 | 2/1887 | Putnam | 52/226 |
| 798,021 | 8/1905 | Eck | 52/226 |
| 1,656,861 | 1/1928 | Leonard | 52/226 |
| 1,658,535 | 2/1928 | Neilson | 52/225 |
| 2,092,022 | 9/1937 | Rieger | 52/226 |
| 2,126,511 | 8/1938 | Soule | 52/226 |
| 3,100,555 | 8/1963 | Ashton | 52/655 |
| 3,358,994 | 12/1967 | Miller | 52/223 R |
| 3,380,209 | 4/1968 | Cheskin | 52/655 |

FOREIGN PATENT DOCUMENTS

| | | |
|---|---|---|
| 581580 | 8/1959 | Canada . |
| 843058 | 6/1970 | Canada . |
| 950630 | 7/1974 | Canada . |

*Primary Examiner*—Gene Crosby

*Attorney, Agent, or Firm*—Larson & Taylor

[57] ABSTRACT

A method is described of prestressing structural members wherein there are a pair of longitudinal elements, a plurality of strut elements and a plurality of diagonal members. A plurality of joint connector means enable the strut elements and diagonal members to be interconnected rigidly together as an inner latticework, and the latter to the longitudinal elements. The inner latticework is initially left freely moveable relative to the longitudinal elements, and a prestressing tensile load applied only to said latticework. While the prestressing load is being applied, the longitudinal elements are rigidly secured to the inner latticework. When the prestressing load is then removed, the diagonal members remain in tension, the strut elements remain in compression and the longitudinal elements acquire a compressive load. The prestressing load should not generate any moments or rotational forces at the junctions of diagonals with the strut and longitudinal elements that have not been accounted for. Preferably, the prestressing load is applied to the latticework in a manner so as to be colinear with the longitudinal elements.

6 Claims, 3 Drawing Figures

PRETENSIONING DIAGONALS IN LATTICE BEAM-COLUMNS

This invention relates to a method or technique for prestressing a structural member, such as one used in towers, tower cranes, trusses for space decks, temporary bridging, masts, or the like. More particularly, this invention relates to an improved method for prestressing a lattice beam-column that is relatively simple and reliable. The present invention is particularly well suited for use in the fabrication of lattice beam-columns having off-set diagonals.

BACKGROUND AND DESCRIPTION OF PRIOR ART

Various designs and methods for prestressing structural members of the general type envisaged herein have been known and used for some time. See, for example, Canadian Pat. Nos. 581,580 issued Aug. 18, 1959 to Space Decks Limited; 843,058 issued June 2, 1970 to Luis R. Zamorano; and 950,630 issued July 9, 1974 to Edwin J. Cohen.

The 581,580 patent describes a space deck, for example, a roof or floor spanning a large distance. Such a space deck is said to include components each of which comprises a planar compression member, a junction unit spaced from the plane of the compression member and formed with a tension member securing formation positioned to secure a plurality of tension members in a manner restraining said junction unit from movement in any direction parallel to the compression member. A set of struts is connected between the junction unit and the compression member. The tension members may be threadedly connected to the junction units, to facilitate assembly and adjustment after assembly, for example, to introduce or remove a slight curvature in the assembled space deck. Such a feature is said to be important in large structures as it permits the complete elimination of deadload deflections.

Canadian Pat. No. 843,058 can be said to disclose a prestressed structural member. It discloses what generally could be considered as a latticed beam having diagonal members and a pair of spaced apart longitudinal members. The latticed beam of this patent is intended to be arcuate, i.e., curved. A tensile load is applied to one of the longitudinal members in a manner tending to flatten the curvature thereof, and in so doing, applies a pretensioning tensile force to the diagonal members and one of the longitudinal elements. It is important to note, however, that all elements of the latticework in this patent are "strictly in tension". This is readily apparent from the description on page 1 at lines 3–4, or on page 2 at lines 21–24.

Canadian Pat. No. 950,630 describes a method for erecting an arched, semi-flexible building member. Specifically, a longitudinal compressive force is applied to one longitudinal component of the latticed beam structure shown therein. That compressive force is effective to camber or bend the beam slightly upwardly to a predetermined extent within the elastic limits of that member. It is then locked in position with a predetermined amount of camber, i.e., curvature. In this particular patent, the application of a longitudinal tensile force to the longitudinal member closest to the center of curvature is said to cause the beam to be smoothly cambered upwards "without undesired buckling when the compressive force is applied". Thus, it appears that the diagonal members making up the latticework of the beam of this patent are prestressed in compression only.

These prior art techniques for prestressing the latticework of a structural member are therefore totally different from the prestressing method to be described herewith. These prior art techniques are thought to be limited to specific kinds of prestressed beams, namely, ones which are intended to resist only lateral loads.

SUMMARY OF THE INVENTION

Accordingly, the present invention is thought to embody a method for prestressing a lattice beam-column having characteristics and properties which improve upon prior art structures and techniques used in the patents mentioned above. The present invention is considered to be relatively simple and reliable. Moreover, the present invention envisages a method of prestressing a lattice beam-column by which close control and uniformity in the amount of prestressing is obtainable, especially when the method is carried out in a plant prefabricating lattice beam-columns. This is an important feature since no prestressing operation needs to be implemented in the field during installation of a lattice beam-column as envisaged herein in a building, tower, mast or other such structure.

Thus, there is provided according to this invention a method of prestressing a structural member having a pair of spaced apart longitudinal elements, and a latticework made of a plurality of strut elements and diagonal members rigidly interconnected together by a plurality of joint connector means, said connector means also joining the latticework rigidly to the longitudinal elements, said method comprising the steps of interconnecting the strut elements and diagonal members rigidly together as said latticework, the latticework being freely moveable relative to the longitudinal elements; then applying a tensile load to the latticework only, securing said longitudinal elements rigidly to said latticework while the tensile load is being applied; and removing the tensile load whereby said structural member remains prestressed, with the diagonal members being in tension, the strut elements in compression and the longitudinal elements being in compression.

In a more preferred embodiment the method of prestressing a lattice beam-column as described herein envisages the tensile load being applied longitudinally of the structural member in a manner which precludes uncontrolled moments and rotational forces from being developed at any of the joint connector means. In a still more preferred form, the tensile load of this method is applied colinearly of the longitudinal elements.

In yet another form of this invention, the present method envisages the tensile load being applied as active, oppositely directed forces applied to each end of the latticework. The tensile load applied in carrying out the method of this invention envisages the application of both deadweight loads as well as liveloads applied by press means activated hydraulically, by screw thread means or the like.

Other features and advantages of the present invention will become apparent from the detailed description which follows. That description is to be read in conjunction with the accompanying drawings that illustrate various features of this invention.

DESCRIPTION OF THE PREFERRED EMBODIMENTS

Figure 1:
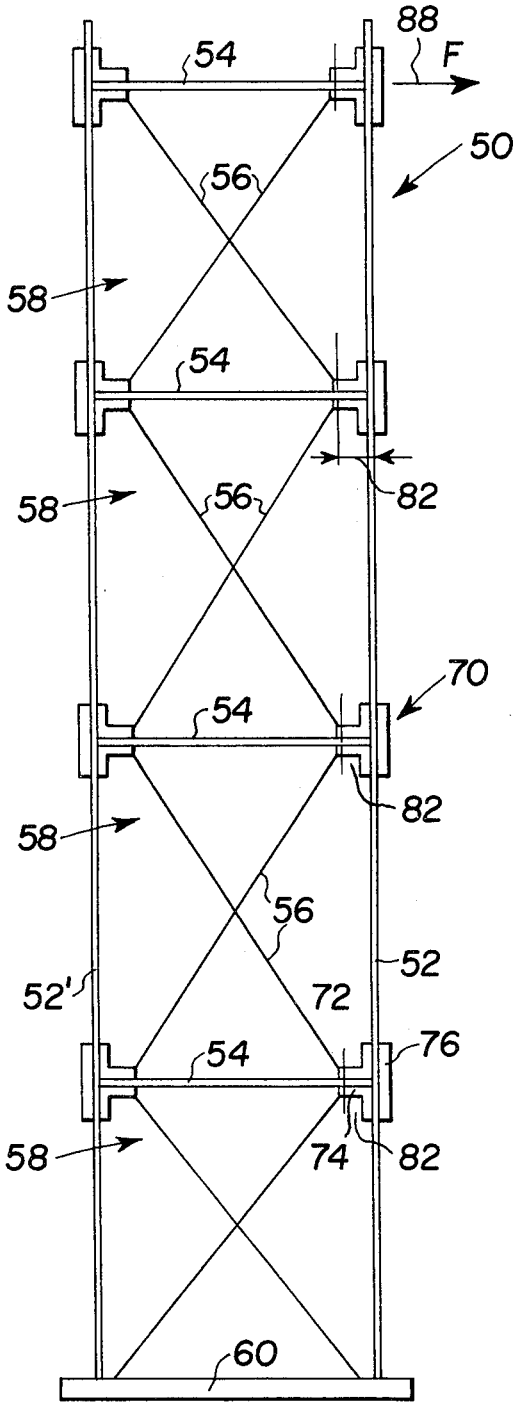
FIG. 1 is a schematic drawing taken in front elevation to show a lattice beam-column fabricated using the method of this invention.

In FIG. 1, a prototype of a preferred kind of structural member fabricated in using this invention is shown overall at 50. Structural member 50 conforms to structural member 10 of FIG. 1(a) of this applicant's copending application noted above, and thus, includes longitudinal elements 52 and 52', cross arms or strut elements 54 and diagonal members 56. The longitudinal elements 52 and 52' and strut elements 54 are prestressed in compression, while the diagonals 56 are prestressed in tension. This will be described more fully below.

In the prototype prestressed structural member 50, the longitudinals 52 and 52', and strut elements 54 were made of rectangular steel bars, dimensioned as 3 mm by 20 mm in cross-section. From a stress/strain curve of the material loaded in tension, the proportional limit for this steel was taken as 445 MPa. The diagonal members 56 were of high strength, solid steel rods of circular cross-section having a diameter of 3.175 mm. This steel had a proportional limit taken as 675 MPa. The lattice beam-column or structural member 50 was made of four box sections or bays 58. These box sections 58 were slightly off being square. The outermost box sections 58 measured 182 mm wide by 199 mm long. The two central box sections 58 measured 182 mm by 228 mm long. The structural member 50 was centred on a steel base 60 measuring 242 mm long by 12 mm thick by 20 mm wide, and had an overall height from the base 60 of 854 mm.

A rigid interconnection of the ends of diagonal members 56 and strut elements 54 to the longitudinal elements 52 is achieved by joint connector means shown overall at 70. See FIG. 2 particularly. Each joint connector means 70 in this instance comprises a pair of angle brackets 72 and 74, and a flat connecting plate 76. As indicated previously, the strut elements 54 and diagonal members 56 are initially connected together as a rigid inner structure or latticework. Thus, drilled openings were provided in the ends of each strut element 54 to be alignable with apertures provided in the feet and leg portions 71 and 73 of the angle brackets 72. The center lines of these openings are indicated at 78 and 80 in FIG. 2, with these openings being adapted to receive threaded bolts. The bolts were of 4 mm O.D. and the brackets were made of steel bar stock 6.5 mm thick by 20 mm wide.

In this particular prototype, diagonal members 56 were made of high strength solid steel rod, circular in cross-section. The feet portions 71 of the angle bracket 72 were accordingly drilled at an angle, to receive an end of the diagonal member 56. The centreline of those drill holes is shown at 77 in FIG. 2. The diagonal members 52 are rigidly connected to the brackets 72 and 74, preferably, by brazing or welding. A screw threaded interconnection could also be used or any other alternative which leaves the inner latticework capable of resisting the prestressing load to be applied to it. The angles of the drill holes indicated by centrelines 77 will vary somewhat depending on how square each box section or bay 58 is. This angle is typically in the range from about 30° to about 60°, preferably at about 45° taken from the axis of the strut elements 54. In the prototype illustrated in FIG. 1, those angles were slightly less than 60°. Each diagonal member 56 intersects the axis of strut elements 54 at a location offset inwardly of the geometrical intersection of the axes of longitudinal and strut elements 52 and 54. This offset in FIG. 1 was 16.58 mm, and is shown at 82 in both FIGS. 1 and 2. Each of the longitudinal elements 52 and 54 is also provided with slots at appropriate locations alignable with drill holes in the leg portions 73 of the angle brackets 72. Again, 4 mm O.D. bolts, indicated schematically at $B_1$ were used to secure the pieces together rigidly.

Figure 2:
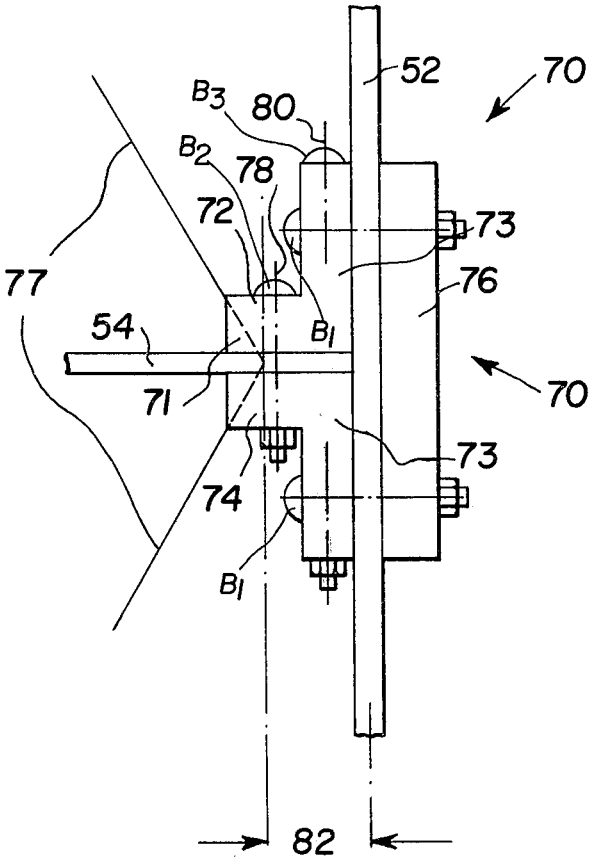
FIG. 2 is also a schematic drawing showing in side elevation structural details of the joint connector means used in the lattice beam-column of FIG. 1 and enabling the present method to be utilized.

With particular reference to FIGS. 1 and 2, the inner latticework is readily constructed by rigidly fastening one of the angle brackets 72 and 74 to the ends of the diagonals 56. That connection is preferably made by brazing or welding with approximately 5–10 mm of the end of the diagonal being closely received in drill holes having centerlines shown at 77. Strut elements 54 are then connected by passing bolts, indicated schematically at $B_2$ and $B_3$, through the drill holes having centerlines shown at 78 and 80, and through the slots or openings so provided in opposite ends of each strut element 54. Tightening down of the nuts associated with such bolts secures the diagonal members 56 and strut elements 54 rigidly into a unitary latticework or inner structure. It is to be noted that in this condition, the latticework is not yet connected to the longitudinal elements 52 and 52'. Thus, that latticework is freely moveable relative to such longitudinal elements.

Figure 3:
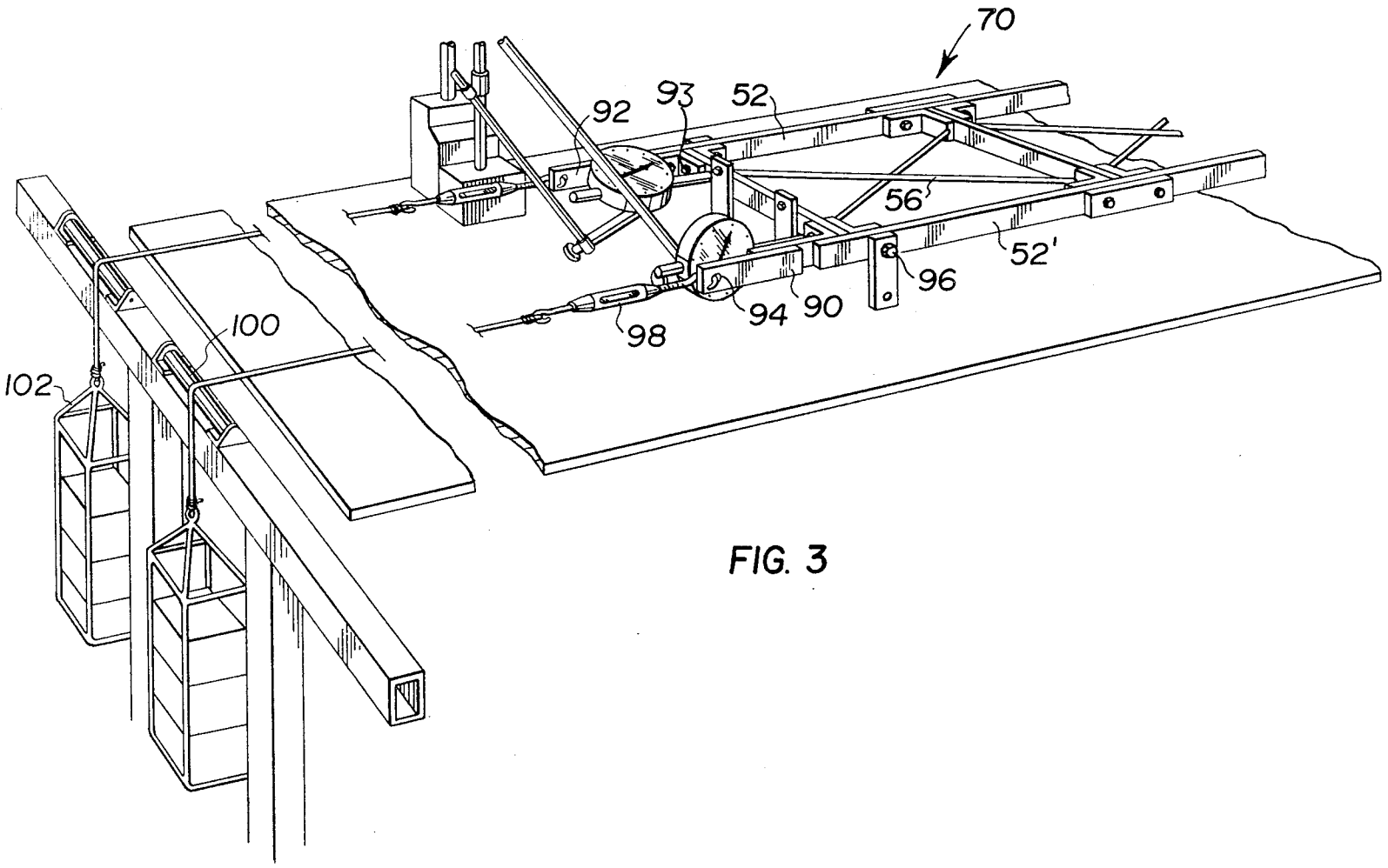
FIG. 3 is a schematic drawing illustrating one preferred technique for applying a prestressing tensile load to the lattice structure of the beam-column of FIG. 1.

In accordance with the present invention, the latticework just described is subject to a prestressing tensile load applied to it. This is best seen with reference to FIG. 3. As shown in that Figure, a pair of stepped brackets 90 and 92 are shown being connected by a threaded fastening means such as bolts 93 to the angle brackets 72 and 74 forming part of the joint connecting means at the end of beam-column 50 opposite to the base 60. In this instance, each of the stepped brackets 90 consisted of a pair of plates of bar stock, overlapped and welded together to form a unitary structure. Opposite ends of that stepped bracket 90 were provided with suitable holes or slots 94 in order, for example, to receive threaded fastening means 96 in the form of a bolt. Bolts 96 secure the stepped brackets 90 to the angle brackets 72 of the uppermost corners or junctions of the beam-column 50 remote from the base 60.

In accordance with the present invention, a prestressing tensile load is applied to the latticework which consists of the strut elements 54 and diagonals 56 rigidly secured together by angle brackets 72 and 74. The hook end of a turnbuckle 98 was received in the slot 94 at the free end of each of the stepped brackets 90. The turnbuckles 98 were in turn connected to cables which passed over a roller 100 and in turn supported cages 102 in which there was placed a number of weights making up the deadweight load being applied longitudinally to the inner latticework. In the prototype beam-columns 50 fabricated and tested, the tensile load was 2.314 kilonewtons.

In accordance with this invention, it is important to note that the prestressing tensile load is applied in a manner which precludes uncontrolled moments or rotational forces being developed at any of the connecting means 70, that is, moments or forces that have not already been taken into account. In the preferred embodiment illustrated in FIG. 3, the stepped bracket 90 is configured so as to cause the lines of force of the tensile load to be colinear with each of the longitudinals 52 and 52'.

While that prestressing tensile load was applied, the connecting plates 76 were rigidly fastened to the angle brackets 72 and 74, forming a rigid interconnection of the structural components 52, 54 and 56 by the joint connector means 70. Upon release of the prestressing tensile load, the diagonals 56 remain in tension, the strut elements 54 remain in compression, and the longitudinal elements 52 acquire a prestressing compressive load.

As already noted, the total prestressing load applied to this prototype was 2.314 kN. Assuming the diagonals to be at an angle of 45°, the pretensioning stress in each diagonal is given by the following equation:

$$\sigma_p = \frac{2.314 \times 1{,}000 \times 1.41}{2 \times A}$$

where A is the cross-sectional area of the diagonal. The calculated pretensioning stress for a diagonal of 3.175 mm diameter was 207 MPa, well below the proportional limit of the brazed diagonal. That Figure took into account any stress relieving effects of the heat involved in brazing the ends of the diagonal members 56 into the joint connector means 70. The heat of brazing is thought to induce a decrease in the value of E, Young's Modulus. However, such a decrease was concluded as acceptable in view of the short length of diagonal involved in the brazing operation.

The technique for pretensioning the lattice beam-column 50 as above-described enabled the prefabrication of a structural member which had considerably improved strength characteristics.

It will be recognized that the technique or method described herein for prestressing a lattice beam-column is relatively simple and reliable. Certain modifications and alternatives will become readily apparent to those knowledgeable in this art. For example, instead of using a deadweight load and cages 102, a press or jack actuated by hydraulic or thread means could also be used. Further, the tensile load applied to the inner latticework could be generated by actively applying a pulling force at opposite ends of the beam-column 50. Accordingly, it is envisaged by this invention to include all such modifications and changes as would be obvious to those skilled in this art, and which fall within the scope of the claims below.

The embodiments of the invention in which an exclusive property or privilege is claimed are defined as follows:

1. A method of prestressing a structural member having a pair of spaced apart longitudinal elements, and a latticework made of a plurality of strut elements and diagonal members rigidly interconnected together by a plurality of joint connector means, said connector means also joining the latticework rigidly to the longitudinal elements, said method comprising the steps of (a) interconnecting the strut elements and diagonal members rigidly together as said latticework, the latticework being freely moveable relative to said longitudinal elements;

(b) applying a tensile load to said latticework only;

(c) securing said longitudinal elements rigidly to said latticework while said tensile load is being applied; and (d) removing said tensile load whereby said structural member remains prestressed, with the diagonal members in tension, the strut elements in compression and the longitudinal elements in compression.

2. The method defined in claim 1, wherein said tensile load is applied longitudinally of the structural member in a manner precluding uncontrolled moments and rotational forces from being developed at any of the joint connector means.

3. The method defined in claim 1, wherein said tensile load is applied colinearly of the longitudinal elements.

4. The method defined in claim 1, 2 or 3, wherein the diagonal members are secured to the joint connector means by brazing.

5. The method defined in claim 1, 2 or 3, wherein the strut and longitudinal elements and the diagonal members are interconnected rigidly by threaded fastener means.

6. The method defined in claim 1, 2 or 3, wherein the tensile load is applied as a dead weight load.

* * * * *